US011548127B2

(12) United States Patent
Mori

(10) Patent No.: US 11,548,127 B2
(45) Date of Patent: Jan. 10, 2023

(54) BLIND RIVET FASTENING APPARATUS

(71) Applicant: Newfrey LLC, New Britain, CT (US)

(72) Inventor: Daisuke Mori, Toyohashi (JP)

(73) Assignee: Newfrey LLC, New Britain, CT (US)

( * ) Notice: Subject to any disclaimer, the term of this patent is extended or adjusted under 35 U.S.C. 154(b) by 453 days.

(21) Appl. No.: 16/746,330

(22) Filed: Jan. 17, 2020

(65) Prior Publication Data

US 2020/0238489 A1 Jul. 30, 2020

(30) Foreign Application Priority Data

Jan. 30, 2019 (JP) ..... JP2019-013951

(51) Int. Cl.

| | |
|---|---|
| ***B25B 27/00*** | (2006.01) |
| ***B21J 15/10*** | (2006.01) |
| ***B21J 15/12*** | (2006.01) |
| ***B21J 15/26*** | (2006.01) |

(52) U.S. Cl.

CPC ..... *B25B 27/0014* (2013.01); *B21J 15/105* (2013.01); *B21J 15/12* (2013.01); *B21J 15/26* (2013.01)

(58) Field of Classification Search

CPC .... B25B 27/0014; B25B 21/00; B21J 15/105; B21J 15/12; B21J 15/26; H02K 7/116

See application file for complete search history.

(56) References Cited

U.S. PATENT DOCUMENTS

| | | | | |
|---|---|---|---|---|
| 5,605,070 | A * | 2/1997 | Wille | F16D 41/206 72/391.8 |
| 7,346,970 | B2 * | 3/2008 | Stager | B25B 27/0014 72/391.2 |
| 2011/0271504 | A1 * | 11/2011 | Preti | B21J 15/26 29/243.524 |
| 2015/0074964 | A1 * | 3/2015 | Masugata | B21J 15/26 29/243.526 |

FOREIGN PATENT DOCUMENTS

| | | | | |
|---|---|---|---|---|
| DE | 10342143 | B4 * | 7/2007 | B25B 27/0014 |
| EP | 0043217 | A1 * | 1/1982 | B25B 27/0014 |
| EP | 0456269 | A2 * | 11/1991 | B21J 15/048 |

(Continued)

OTHER PUBLICATIONS

Extended European Search Report in corresponding European Patent Application No. 20154303.0 dated Jul. 6, 2020.

*Primary Examiner* — Bayan Salone

(74) *Attorney, Agent, or Firm* — Harness, Dickey & Pierce, P.L.C.

(57) ABSTRACT

A clutch apparatus for releasing the transmission of rotation from an electric motor to a spin shaft, is equipped with a rear clutch nut and a front clutch nut in order from the rear end side. The rear clutch nut transmits rotating force from the electric motor to the front clutch nut when engaged with the front clutch nut, but is disengaged from the front clutch nut by a predetermined rotation load. The front clutch nut has a cylindrical shape, so that the spin shaft can be arranged at an axial center portion, and when engaged with the engaging (Continued)

unit of the spin shaft, the rotating force is transmitted to the spin shaft, but the clutch is disengaged by a backward stroke of the front clutch nut and a predetermined stroke toward the tip of the spin shaft.

7 Claims, 16 Drawing Sheets

(56) References Cited

FOREIGN PATENT DOCUMENTS

| | | | | | |
|---|---|---|---|---|---|
| EP | 0670199 | A1 | * | 9/1995 | ..... F16D 41/206 |
| EP | 2409814 | A1 | | 1/2012 | |
| GB | 1457326 | A | * | 11/1976 | ..... B21J 15/043 |
| GB | 1457326 | A | | 12/1976 | |
| JP | 07256383 | A | * | 10/1995 | ..... B25B 27/0014 |
| JP | H07256383 | A | | 10/1995 | |
| WO | WO-2013/180769 | A1 | | 12/2013 | |
| WO | WO-2013180769 | A1 | * | 12/2015 | ..... B21J 15/26 |

* cited by examiner

BLIND RIVET FASTENING APPARATUS

CROSS-REFERENCE TO RELATED APPLICATIONS

This application claims the benefit and priority of Japanese Patent Application Number 2019-013951 filed Jan. 30, 2019. The entire disclosure of the above application is incorporated herein by reference.

FIELD

The present disclosure relates to an apparatus for fastening a blind nut to a member to be mounted.

BACKGROUND

An apparatus for fastening a blind nut to a member to be mounted (a blind nut tool) is required to perform two operations: rotation of a mandrel (mounting of a blind nut to a mandrel) and stroke (fastening of a blind nut).

In the case of the current pneumatic type blind nut tool, mounting is performed by an air motor, and fastening is performed by a hydraulic cylinder; however, in the case of an electric cordless blind nut tool, it is difficult to mount two motors—one for mounting and one for fastening—on the tool due to concerns about increased size and weight. In the case of a conventional tool with a POP electric cord, the mounting operation and the fastening operation are performed by one trigger operation; therefore, blind nut mounting and fastening cannot be operated individually, and fastening starts immediately after mounting is completed, so that it is necessary either to insert the blind nut into the work in advance or turn the blind nut by hand to mount it on the tool.

As described in Patent Document 1, while a tool exists that can individually operate mounting and fastening with one motor, the workability thereof is not satisfactory because two trigger operations are required for the mounting operation and the fastening operation.

Additionally, in Patent Document 2, while the blind nut can be mounted by pressing a mandrel, another motor is required for mounting. Further, cordless tools on the market are only able to use either fastening stroke management or fastening load management for fastening management. In Patent Document 3, measurement and the like can be performed together with the fastening force and stroke, but fastening control is performed only by the load.

Further, these existing tools require a position confirmation sensor for confirming the positions of the forward end and the backward end of the tool, and if the sensor fails, the tool may be damaged.

PRIOR ART DOCUMENT

Patent Document

[Patent Document 1] Japanese Unexamined Patent Publication No. HEI7-256383

[Patent Document 2] US Patent No. 2011/0,271,504

[Patent Document 3] European Patent No. 3,202,536

SUMMARY

Problem to be Solved

Accordingly, an object of the present disclosure is to provide a blind nut fastening apparatus with improved mechanisms and controls for the mounting and fastening operations.

Means for Solving the Problem

To achieve the above-stated object, one aspect of the present disclosure is a fastening apparatus for fastening a blind nut to a member to be mounted, the fastening apparatus is provided with a power transmission unit configured to transmit the rotation of the electric motor, having a first transmission system and a second transmission system;

a joint shaft that is arranged in front of the electric motor and is rotated by transmitting power by the first transmission system of the power transmission unit;

a spindle that is arranged in front of the electric motor and that is rotated by transmitting power by the second transmission system of the power transmission unit;

a spin shaft that grips a shaft unit of a mandrel and rotates the mandrel with rotation of the joint shaft;

a rotating clutch for transmitting the rotating force of the joint shaft to the spin shaft; and a stroke clutch that is disposed between a stroke mechanism that strokes the mandrel with the rotation of the spindle and the spindle, and that transmits the rotation of the spindle to the stroke mechanism;

wherein the rotation clutch is provided with a rear clutch nut and a front clutch nut in order from the rear end side;

the rear clutch nut transmits the rotational force of the joint shaft to the front clutch nut when engaged with the front clutch nut, but is disengaged from the front clutch nut by a predetermined rotational load;

the front clutch nut has a cylindrical shape, the spin shaft can be arranged at an axial center unit, and is configured so that when it is engaged with an engagement unit of the spin shaft a rotational force is transmitted to the spin shaft, but is disengaged by a predetermined stroke toward the tip of the spin shaft;

the stroke clutch is provided with a spindle clutch and a nut clutch in order from the rear end side; and the spindle clutch transmits the rotational force of the spindle to the stroke mechanism when engaged with the nut clutch, but is disengaged from the nut clutch by a predetermined stroke toward the rear end of the mandrel.

In the fastening apparatus, preferably, the stroke mechanism that strokes the mandrel is provided with a cylindrical ball screw nut that rotates with the rotation of the spindle clutch and the nut clutch, and a ball screw shaft that is prepared at the center of the ball screw nut and that moves the mandrel by moving in the axial direction with the rotation of the ball screw nut.

The fastening apparatus, preferably, further comprises a spin-pull head case that is disposed on the tip side of the ball screw shaft and that moves in the same direction as the ball screw shaft with the stroke of the ball screw shaft; when the spin-pull head case moves a predetermined distance in the rear end direction, it is engaged with a spin-pull head disposed on the front end side of the spin shaft, and moves so as to retract the mandrel together with the spin-pull head.

The fastening apparatus, preferably, is further provided with a switch to start the electric motor by pressing the mandrel in the axial direction, so that when the front end of the mandrel is pressed toward the rear end in a state in which the blind nut is arranged at the front end of the mandrel, the switch of the electric motor is closed, and the rotational force from the electric motor rotates the mandrel via the spin shaft engaged with the rotating clutch; when the blind nut is mounted on the mandrel, the mandrel and the spin shaft are stroked in the distal direction, so that the spin shaft is disengaged from the rotation clutch, and the switch is opened; when the electric motor is started via a trigger by a user operation in a state in which the spin shaft is disengaged from the rotation clutch, by rotating the spindle and stroking the mandrel toward the rear end via the stroke mechanism, the blind nut is fastened to the member to be mounted.

In the fastening apparatus, preferably, the rear clutch nut has a cylindrical unit and a flange unit at one end of the cylindrical unit, and a plurality of first sector-shaped portions are formed on a front surface of the flange unit; the first fan-shaped portion is a first vertical surface having one end in a circumferential direction perpendicular to an end surface of the flange unit, and the other end is a first inclined surface inclined with respect to the end surface of the flange unit, configured to rotate integrally with the joint shaft; the front clutch nut has a plurality of second sector-shaped portions having a shape complementary to the first sector-shaped portion; with the second fan-shaped portion one end in the circumferential direction is a second vertical surface perpendicular to the end surface of the front clutch nut, while the other end is a second inclined surface inclined with respect to the end surface of the front clutch nut; the second vertical surface of the second sector portion of the front clutch nut is capable of engaging the first vertical surface of the first sector portion of the rear clutch nut; the second inclined surface of the second sector portion of the front latch nut is capable of engaging the first inclined surface of the first sector portion of the rear clutch nut; and the front clutch nut is configured to rotate integrally with the rear clutch nut.

In the fastening apparatus, preferably, the blind nut is mounted on the mandrel, and when the spin shaft cannot rotate, the first inclined surface of the first sector portion of the rear clutch nut slips with the second inclined surface of the second sector portion of the front clutch nut, and the rear clutch nut moves rearward.

In the fastening apparatus, preferably, the engagement unit of the spin shaft has a plurality of small-diameter portions having a diameter smaller than a diameter of a columnar shape on the distal end side of the engagement unit, the distal end side of the engagement unit of the spin shaft has a diameter smaller than the diameter of the small diameter portion of the engagement unit, and the inside shape of the cylindrical shape of the front clutch nut has a shape complementary to the engagement unit.

[Effects]

According to the present disclosure, it is possible to provide a blind nut fastening apparatus with improved control for the mounting operation and the fastening operation.

DRAWINGS

DETAILED DESCRIPTION

Example Embodiment

Figure 1:
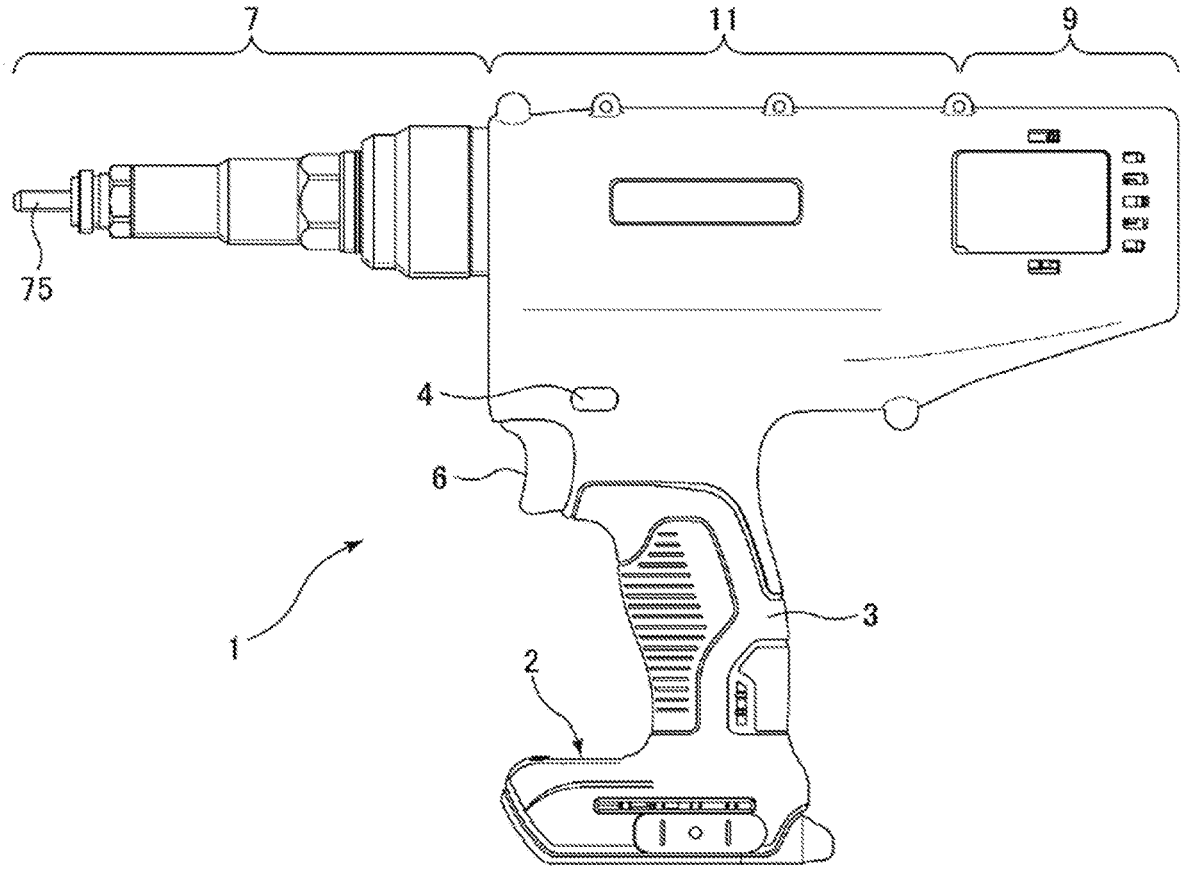
FIG. 1 is a front view of a blind nut fastening apparatus according to an embodiment of the present disclosure.
Figure 2:
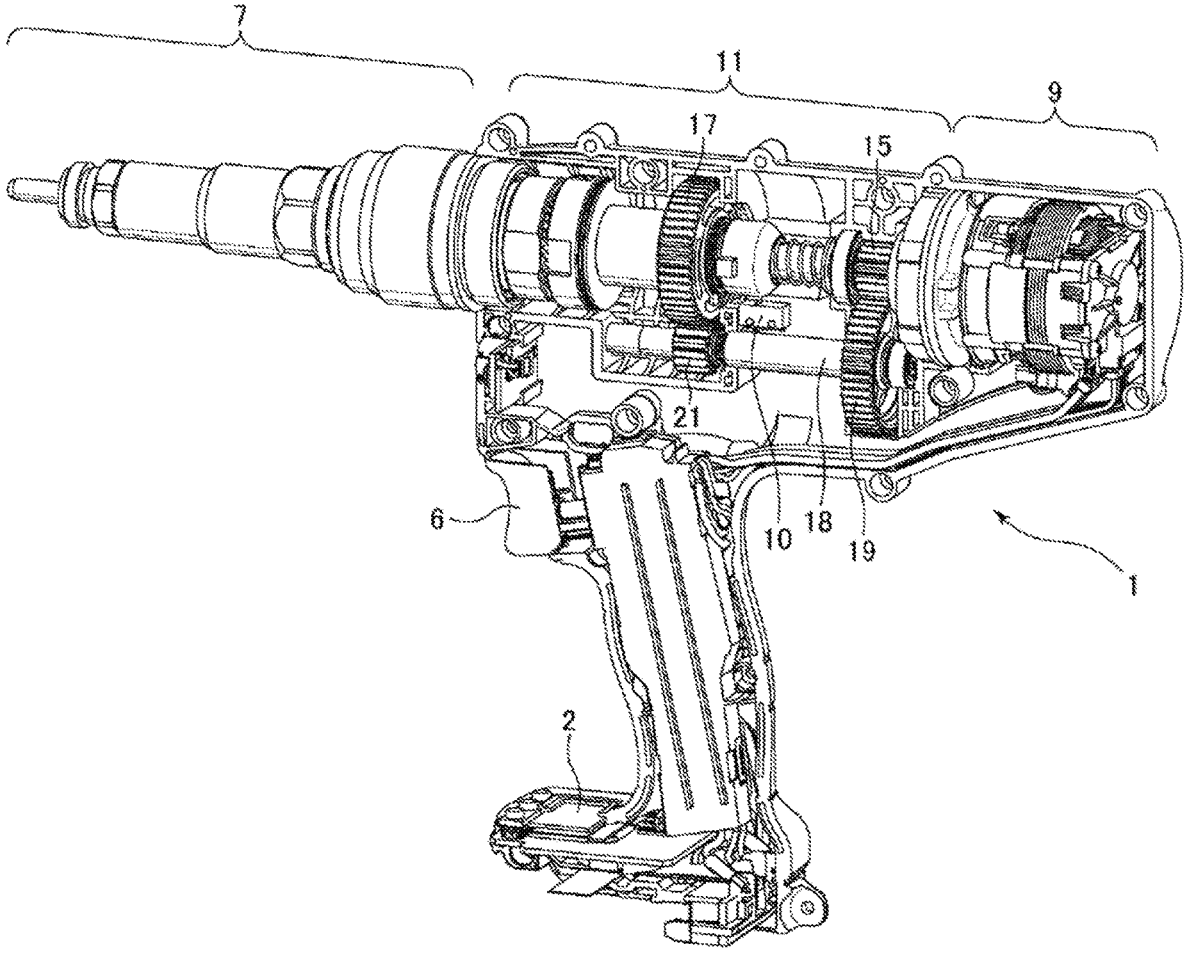
FIG. 2 is a perspective cutaway view showing the parts of a motor unit and a power transmission unit of the blind nut fastening apparatus of FIG. 1.
Figure 3:
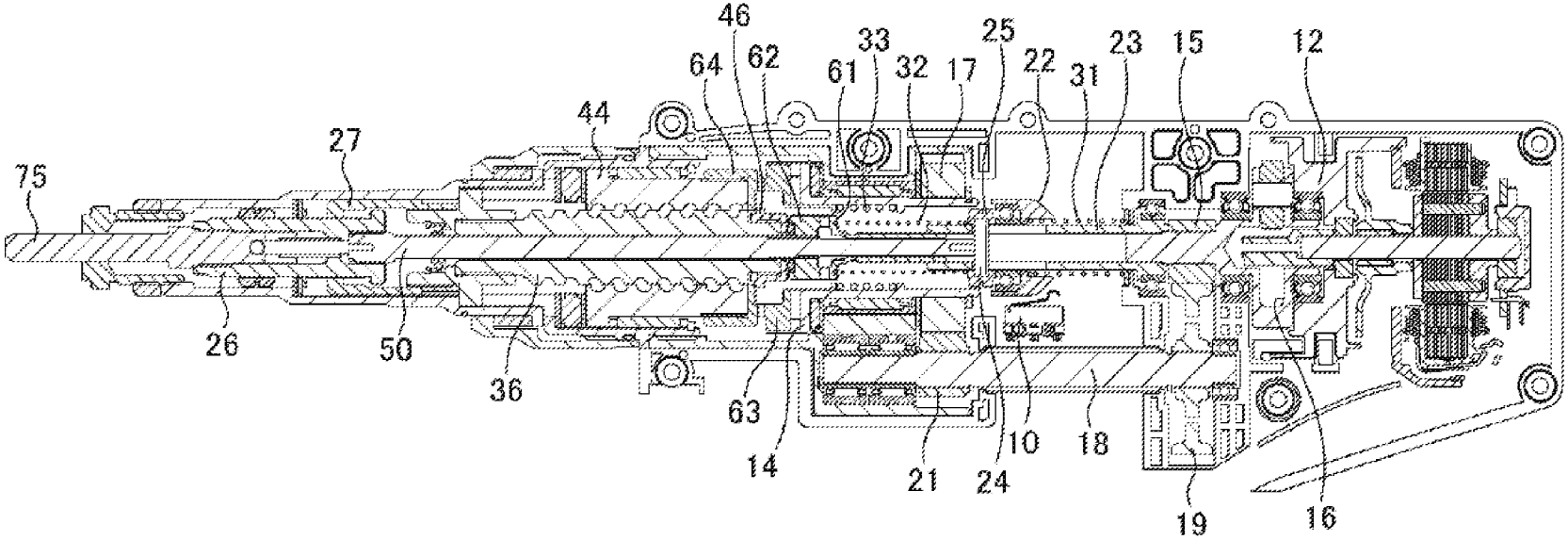
FIG. 3 is a cross-sectional view of the blind nut fastening apparatus of FIG. 1.

Hereinafter, an embodiment of a blind nut fastening apparatus according to the present disclosure will be described with reference to the drawings. FIG. 1 is a front view of a blind nut fastening apparatus according to an embodiment of the present disclosure. FIG. 2 is a perspective cutaway view showing the parts of a motor unit and a power transmission unit of the blind nut fastening apparatus of FIG. 1. FIG. 3 is a cross-sectional view of the blind nut fastening apparatus of FIG. 1.

The blind nut fastening apparatus 1 is provided with a blind nut fastening mechanism housed in a substantially cylindrical tool housing, and a handle 3 extending substantially perpendicularly from an intermediate position of the blind nut fastening mechanism. A battery is detachably attached to a lower portion of the handle 3 (the battery is not shown).

At the tip of the blind nut fastening apparatus 1, there is a mandrel 75; as will be described later, when the blind nut 70 is disposed at the tip of the mandrel 75 and pressed, the electric motor of the motor unit 9 operates, and the blind nut 70 can be automatically mounted on the mandrel 75.

A trigger 6 is established on the upper part of the handle 3. When the operator pulls the trigger 6, the mandrel 75 is pulled in the rear end direction to perform the fastening operation of the blind nut 70.

As shown in FIGS. 1 and 2, the blind rivet fastening mechanism comprises a nose 7 at the front (left side in FIG. 1), a motor unit 9 at the rear (right side in FIG. 1), and a power transmission unit 11 at the center. The motor unit 9 accommodates an electric motor including a brushless motor 12. The nose 7 is established with a configuration for gripping and pulling the shaft unit of the mandrel 75.

[Motor Unit]

The motor unit 9 shown at the rear end position of FIGS. 1 to 3 will now be described. In one embodiment, the electric motor is a brushless motor 12. In the brushless motor 12, the rotor is a magnet, and the winding circuit is on the stator side. The rotation angle of the rotor is detected by a Hall element 13A (magnetic sensor) incorporated in the brushless motor 12. The electronic circuit for the brushless motor 12 performs switching at a timing according to the magnetic pole of the rotor. By detecting the number of rotations of the rotor of the brushless motor 12, the axial position of the retraction of the spin shaft 50 or the like can be obtained.

[Power Transmission Unit]

The power transmission unit 11 has two systems: a first transmission system that transmits the rotation of the brushless motor 12 to the joint shaft 23, and a second transmission system that transmits the rotation of the brushless motor 12 to the spindle 14. The rotating operation of the joint shaft 23 contributes to the function of rotating the spin shaft 50, and the rotating operation of the spindle 14 contributes to the function of rotating the spin shaft 50.

As shown in FIG. 2, a power transmission unit 11 is established between the motor unit 9 and the nose 7. The power transmission unit 11 comprises a motor gear 15, a rear gear 19, a second shaft 18, a front gear 21, and a spindle gear 17.

A motor gear 15 connected to a motor shaft of the brushless motor 12 is arranged on the motor unit 9 side of the power transmission unit 11, and on the front side, a spindle gear 17 is arranged, connected to a spindle 14 having an axis coaxial with the axis of the motor shaft.

The motor gear 15 renders a rotational force to the joint shaft 23 in front thereof, and the rotation of the joint shaft 23 is transmitted to the spin shaft 50 via a rear clutch nut 61 and a front clutch nut 62, as will be described later.

Meanwhile, a second shaft 18 is established in a lower space between the motor gear 15 and the spindle gear 17. The second shaft 18 is rotatably supported around an axis in a direction parallel to the motor shaft of the brushless motor 12 and the axis of the spindle 14. A rear gear 19 that engages with the motor gear 15 is attached to the rear end of the second shaft 18, and a front gear 21 that engages with the spindle gear 17 is attached to the front end of the second shaft 18. The second shaft 18 is a single shaft; it connects the rear gear 19 and the front gear 21. The second shaft 18, the front gear 21 and the like are housed in a tool housing.

Since the rear gear 19 is engaged with the motor gear 15, when the brushless motor 12 rotates in the forward direction, the second shaft 18 rotates in the reverse direction. Since the front gear 21 is engaged with the spindle gear 17, when the second shaft 18 rotates in the reverse direction, the spindle gear 17 rotates forward and the spindle 14 rotates in the forward direction. Thereby, the spindle 14 rotates in the same direction as the brushless motor 12. In this manner, the rotation of the brushless motor 12 is transmitted to the spindle 14 via the second shaft 18. The rotation of the spindle 14 is transmitted to a spindle clutch 63 and a nut clutch 64, as will be described later, and further transmitted to a mechanism (stroke mechanism) that strokes the spin shaft 50 at a subsequent stage.

The gear ratio between the motor gear 15 and the rear gear 19, and the gear ratio between the front gear 21 and the spindle gear 17, are arbitrarily determined depending on the balance between the output of the brushless motor 12 and the fastening force of the blind nut.

Figure 13:
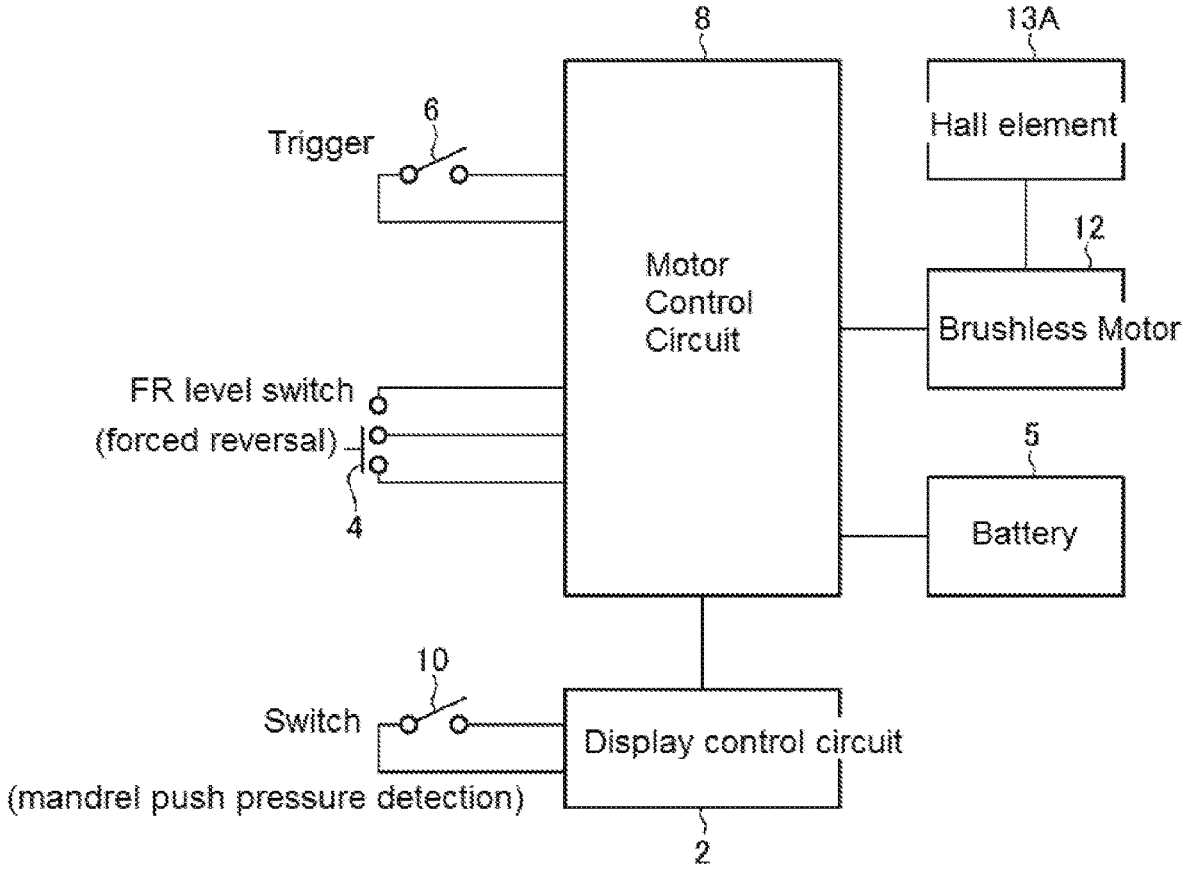
FIG. 13 is a block diagram of a control unit of the blind nut fastening apparatus according to the present disclosure.

Further, the control unit is established, for example, on the steering wheel 3 and the like (but is not limited thereto); it performs various controls by a motor control circuit 8 of FIG. 13 to be described later.

[Rotating Operation of Spin Shaft (Mandrel) when the Blind Nut is Attached]

When the blind nut 70 is pressed from the front of the mandrel 75, the detection collar is pressed, passing through the spin pull head 26, the spin shaft 50, the pin 24 and the pin holder 25, and the switch 10 is closed. The switch 10 is connected to the control unit and detects the signal to rotate the brushless motor 12 a fixed number of times.

Since the motor gear 15 is connected from the first reduction unit 16 to the joint shaft 23, the mandrel 75 rotates at the reduction ratio of the first reduction unit 16 via a rear clutch nut 61 and a front clutch nut 62 (first clutch), and a front clutch nut 62 and a spin shaft 50 (second clutch).

While the blind nut 70 is gradually mounted on the mandrel 75 by a fixed number of rotations of the mandrel 75, when the ball screw shaft 36 strokes a fixed distance, the second clutch is disengaged (detailed mechanism will be described later), and the rotation of the brushless motor 12 is not transmitted. Further, when the blind nut 70 is completely mounted on the mandrel 75 and a certain rotational load is applied, the first clutch is disengaged (detailed mechanism will be described later), the rotational force to the spin shaft is not transmitted, and the rotation of the mandrel 75 stops, so that the blind nut 70 does not buckle due to the rotational force.

[Stroke Operation (Retraction Operation) of the Spin Shaft (Mandrel) when Fastening the Blind Nut]

After the blind nut 70 is mounted on the mandrel 75, when the blind nut is fastened to the member to be mounted, a stroke operation of retracting the mandrel 75 in the rear end direction is performed by the stroke mechanism described below.

Here, in a state where the blind nut 70 is attached to the mandrel 75, the spin shaft 50 is stroked forward, and, as described later, the second clutch (the front clutch nut 62 and the spin shaft 50) is disengaged. Therefore, when the mounting of the blind nut 70 on the mandrel 75 is completed, rotational force is not transmitted on the spin shaft 50.

At the stage when the blind nut 70 is mounted on the mandrel 75, the rotation of the spindle 14 is connected to the third clutch (the spindle clutch 63 and the nut clutch 64). Then, the rotation of the third clutch rotates the ball screw nut 44 and causes the ball screw shaft 36 to stroke in the axial direction by screwing the inner screw of the ball screw nut 44 and the outer screw of the ball screw shaft 36.

The spin-pull head case 27 is disposed in front of the ball screw shaft 36 and moves in the same direction as the ball screw shaft 36 with the stroke of the ball screw shaft 36. The spin-pull head case 27 is configured to fit with the spin-pull head 26 arranged at the front stage of the spin shaft 50 when moved by a predetermined distance in the rear end direction; from this stage, the spin-pull head 26 is retracted along with the mandrel 75 toward the rear end.

However, before the installation of the blind nut 70 on the mandrel 75 is completed, an axial gap is established between the spin-pull head 26 and the spin-pull head case 27; at this stage, the mandrel 75 does not stroke.

Thereafter, in a state in which the mounting of the blind nut 70 to the mandrel 75 is completed, the ball screw nut 44 is rotated a predetermined number of times so that the ball screw shaft 36 is stroked backward, and there is no axial gap between the spin-pull head 26 and the spin-pull head case 27.

Therefore, when the trigger 6 is retracted in this state, the rotation of the brushless motor 12 is transmitted to the third clutch (the spindle clutch 63 and the nut clutch 64) via the spindle 14, the ball screw nut 44 is rotated by the rotational force from the third clutch, and the ball screw shaft 36 is moved in the direction of retraction. At this time, the spin-pull head case 27 linked to the ball screw shaft 36 is retracted without rotating the spin shaft 50 and the mandrel 75 via the spin-pull head 26, so that the blind nut 70 can be fastened to the member to be mounted.

[Overview of Clutches]

As described above, provided in the present disclosure as clutches are a first clutch (rear clutch nut 61 and front clutch nut 62), a second clutch (front clutch nut 62 and spin shaft 50), and a third clutch (spindle clutch 63 and nut clutch 64).

The first clutch and the second clutch have a function of transmitting the rotational force of the joint shaft 23 to the rotation of the spin shaft 50. The second clutch has a function of preventing a rotational force from being transmitted to the spin shaft 50 by the constant stroke of the spin shaft 50. Further, the first clutch has a function of disengaging due to the constant rotational load and preventing the transmission of a rotational force.

Further, the third clutch transmits the rotational force of the spindle 14 to the ball screw nut 44, thereby connecting the stroke of the ball screw shaft 36 and the spin shaft 50, and it has a function of preventing the rotation force from being transmitted to the ball screw nut 44 so that the spin shaft 50 does not overstroke beyond a certain stroke.

[First Clutch]

Figure 4:
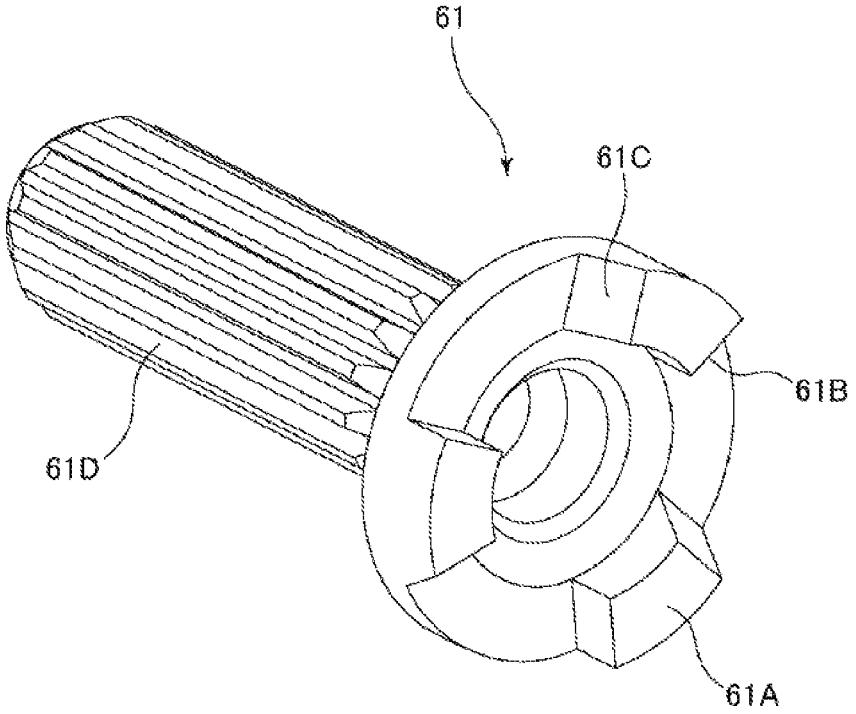
FIG. 4 is a perspective view of a rear clutch nut.
Figure 5:
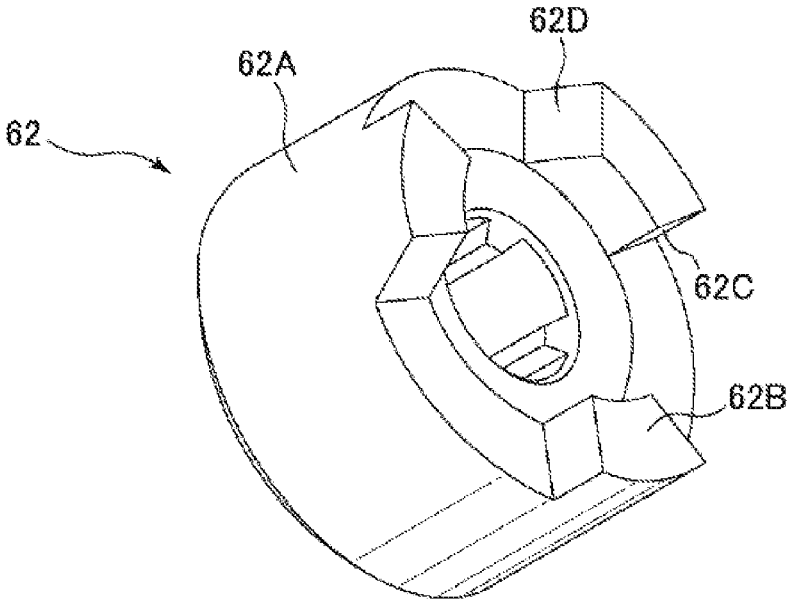
FIG. 5 is a perspective view of a front clutch nut.

The structure of the first clutch can be explained from the rear clutch nut 61 shown in FIG. 4 and the front clutch nut 62 shown in FIG. 5.

The rear clutch nut 61 has a flange unit at the tip, and the flange unit is formed with a first sector-shaped portion 61A that is one step higher in an arc shape having a constant width in the radial direction. In the example of FIG. 4, three first fan-shaped portions 61A are formed at equal intervals, but may be two or four or more. One end surface in the circumferential direction of the first fan-shaped portion 61A is a first vertical surface 61B perpendicular to the surface of the flange unit, and the other end surface is a first inclined surface 61C inclined relative to the surface of the flange unit. The rear clutch nut 61 is formed with a rear end portion 61D formed on the rear end side of the flange portion and is further adapted to receive a rotational force from the joint shaft 23 at the subsequent stage.

The front clutch nut 62 is arranged in front of the rear clutch nut 61 and engages with the rear clutch nut 61.

The front clutch nut 62 has a cylindrical portion 62A so that the spin shaft 50 can be inserted into the center, and the rear end face has a second fan-shaped portion 62B that is one step higher in an arc shape having a constant width in the radial direction. In the example of FIG. 5, three second fan-shaped portions 62B are formed at equal intervals, but may be two or four or more. That is, the first fan-shaped portion 61A of the rear clutch nut 61 and the second fan-shaped portion 62B of the front clutch nut 62 have complementary shapes. One circumferential end surface of the second fan-shaped portion 62B is a second vertical surface 62C perpendicular to the rear end surface of the front clutch nut 62, and the other end surface is a second inclined surface 62D inclined with respect to the rear end surface of the front clutch nut 62.

The first inclined surface 61C of the rear clutch nut 61 comes into contact with the second inclined surface 62D of the front clutch nut 62 when the motor is rotating forward, so that the blind nut 70 is mounted on the mandrel 75. By completion of the attachment of the blind nut 70 to the mandrel 75 and the increased resistance to the rotation of the spin shaft, when a certain load is applied to this contact portion, due to the inclined structure of the first inclined surface 61C and the second inclined surface 62D, the first fan-shaped portion 61A of the rear clutch nut 61 is disengaged from the second fan-shaped portion 62B of the front clutch nut 62, and the rotational force is not transmitted; at this time, the rear clutch nut 61 moves toward the rear end while being supported by a spring 32.

On the other hand, the first vertical surface 61B of the rear clutch nut 61 comes into contact with the second vertical surface 62C of the front clutch nut 62 when the motor is rotating in the reverse direction, so that the load when removing the blind nut 70 from the mandrel 75 can be withstood.

[Second Clutch]

Figure 6:
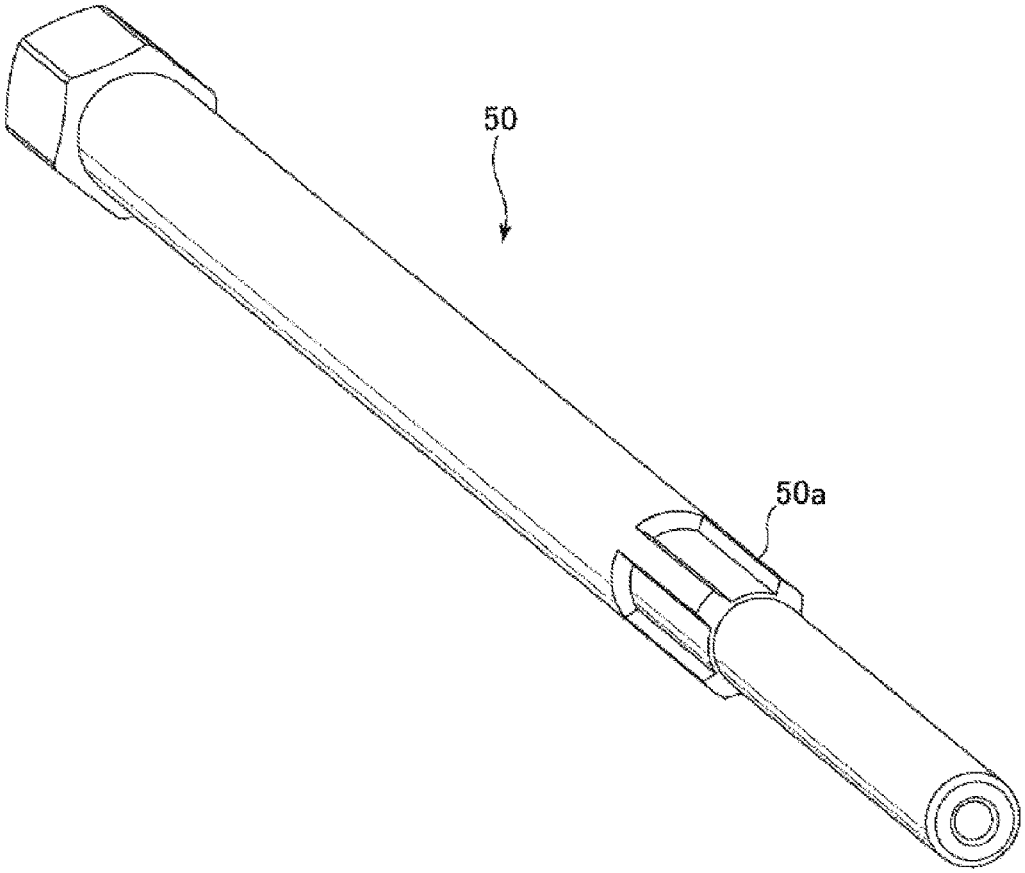
FIG. 6 is a perspective view of a spin shaft.

The structure of the second clutch can be explained from the front clutch nut 62 shown in FIG. 5 and the spin shaft 50 shown in FIG. 6.

As described above, the spin shaft 50 can be inserted into the center (axial portion) of the front clutch nut 62, and moves relative to the front clutch nut 62 in the axial direction by a stroke. The spin shaft 50 is adapted to engage with the inner shape of the front clutch nut 62 when the front clutch nut 62 is at the position of the engaging unit 50*a*. The front end side of the engaging unit 50*a* of the spin shaft 50 has a cylindrical shape; the engaging unit 50*a* includes a first portion having a diameter substantially equal to the diameter of the cylindrical shape on the distal end side, and a second portion (small diameter portion) having a smaller diameter than the cylindrical shape on the distal end side. In the engagement unit 50*a*, a plurality of first portions and second portions are provided. The rear end side of the engaging unit 50*a* of the spin shaft 50 also has a cylindrical shape, but is formed with a diameter smaller than the diameter of the second portion (small diameter portion). The inner shape of the front clutch nut 62 has a complementary shape so as to fit with the first and second portions of the engagement unit 50*a*. In a state in which the spin shaft 50 is inserted into the center (axial portion) of the front clutch nut 62, the front clutch nut 62 cannot move to the front end side farther than the engagement unit 50*a* due to the relationship between the diameters of the front end side and the rear end side of the engagement unit 50*a* of the spin shaft 50, but it can move to the rear end side. With such a configuration, the engagement of the front clutch nut 62 is released by moving from the engagement unit 50*a* of the spin shaft 50 to the rear end side. When the rotational force is transmitted to the front clutch nut 62 while the spin shaft 50 and the front clutch nut 62 are engaged, the spin shaft 50 rotates.

[First Clutch and Second Clutch (Rotating Clutch)]

As described above, the first clutch and the second clutch control whether or not to transmit a rotational force to the spin shaft 50.

Figure 7:
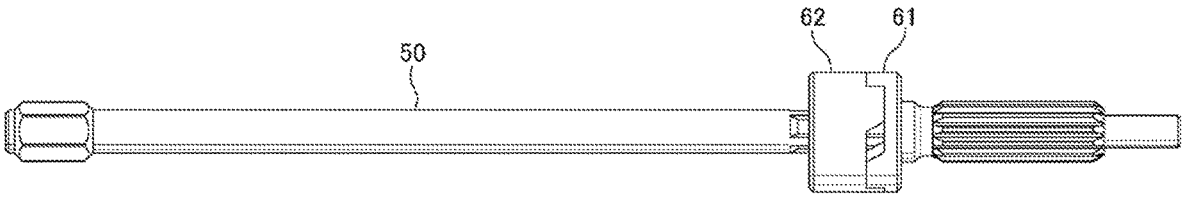
FIG. 7 is a view showing a connected state of a first clutch (a rear clutch nut and a front clutch nut) and a second clutch (a front clutch nut and a spin shaft).
Figure 8:
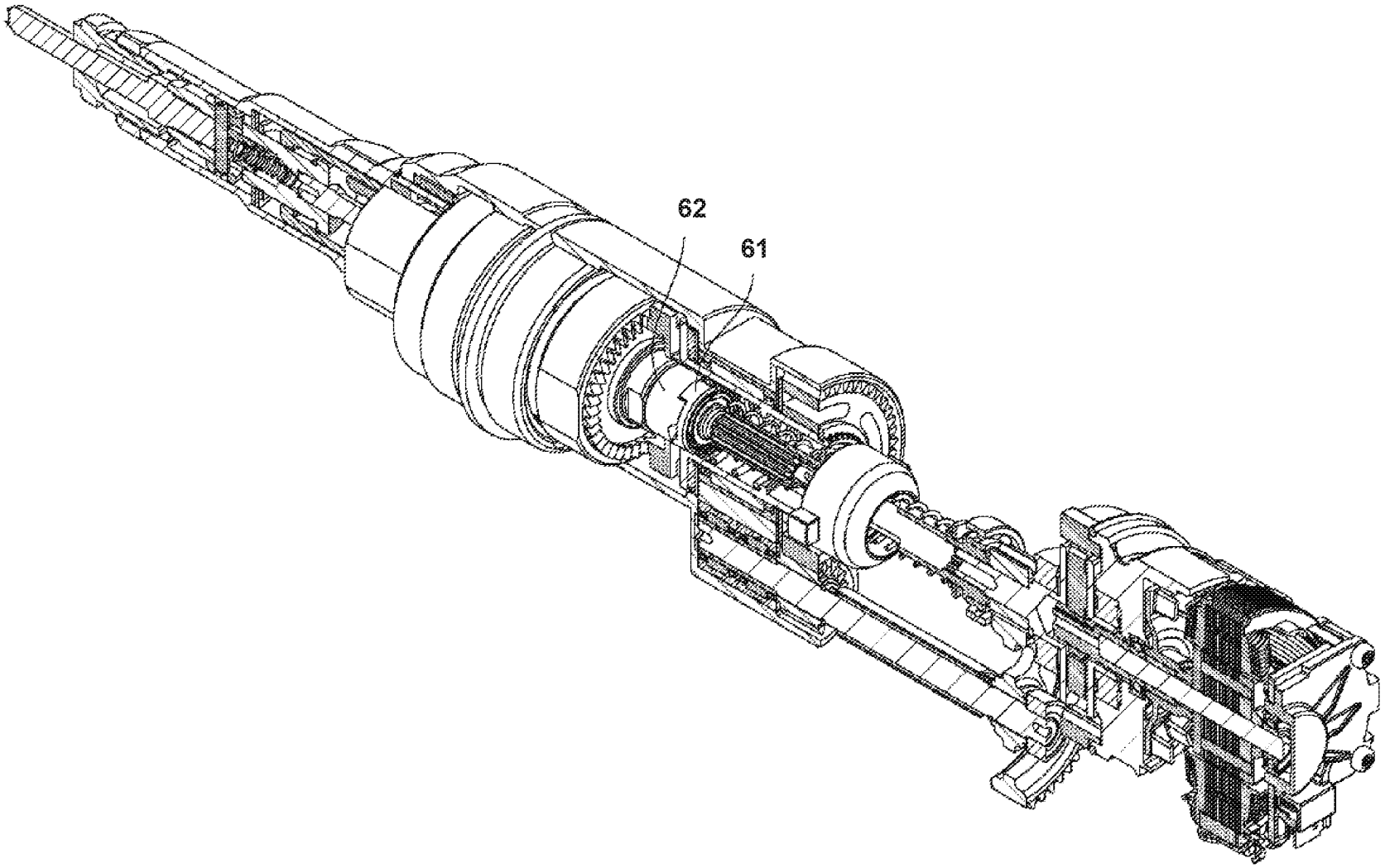
FIG. 8 is a perspective view showing a state in which the first clutch and the second clutch of FIG. 7 are incorporated in the entire blind nut fastening apparatus.

FIG. 7 shows a state in which the spin clutch 50 and the front clutch nut 62 are further connected as the second clutch, in addition to connecting the rear clutch nut 61 and the front clutch nut 62 as the first clutch. FIG. 8 is a perspective view showing a state in which the first clutch and the second clutch of FIG. 7 are incorporated in the entire blind nut fastening apparatus.

In the state of FIG. 7, the rotational force from the joint shaft 23 is transmitted to the spin shaft 50 via the rear clutch nut 61 and the front clutch nut 62, and the mandrel 75 can be rotated.

In the state of FIG. 7, the rear clutch nut 61 and the front clutch nut 62 are engaged with each other and rotate integrally; however, when the relative position of the spin shaft 50 with respect to the rear clutch nut 61 and the front clutch nut 62 moves in the axial direction and the engagement between the spin shaft 50 and the front clutch nut 62 is released, the rotation force is not transmitted to the spin shaft 50. In addition, when the mounting of the nut is completed and the rotational load applied to the rear clutch nut 61 exceeds a certain value, due to the above-mentioned shape characteristics of the rear clutch nut 61 and the front clutch nut 62, the first inclined surface 61C of the rear clutch nut 61 and the second inclined surface 62D of the front clutch nut 62 slip, the engagement thereof is released, and the rotational force is not transmitted to the spin shaft 50. That is, the first clutch and the second clutch are configured to be disengaged by a rotational load or a stroke.

[Third Clutch (Clutch for Stroke)]

Figure 9:
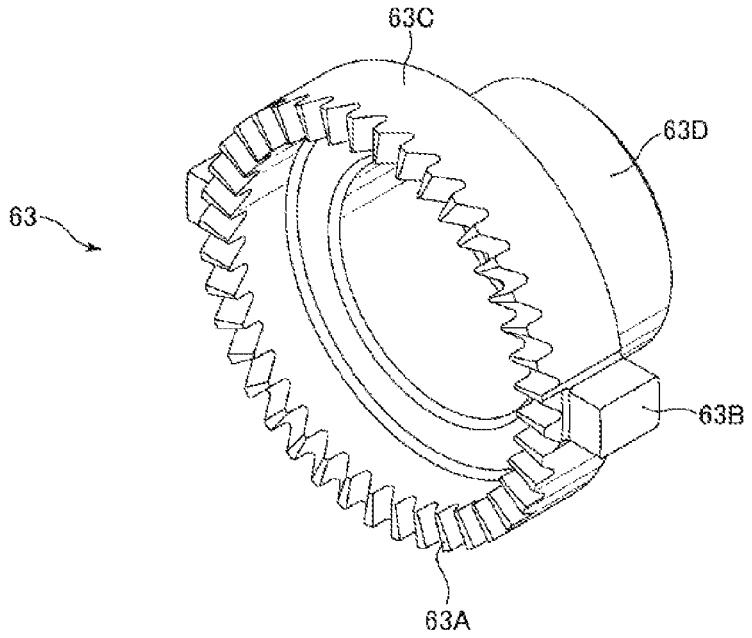
FIG. 9 is a perspective view of a spindle clutch.
Figure 10:
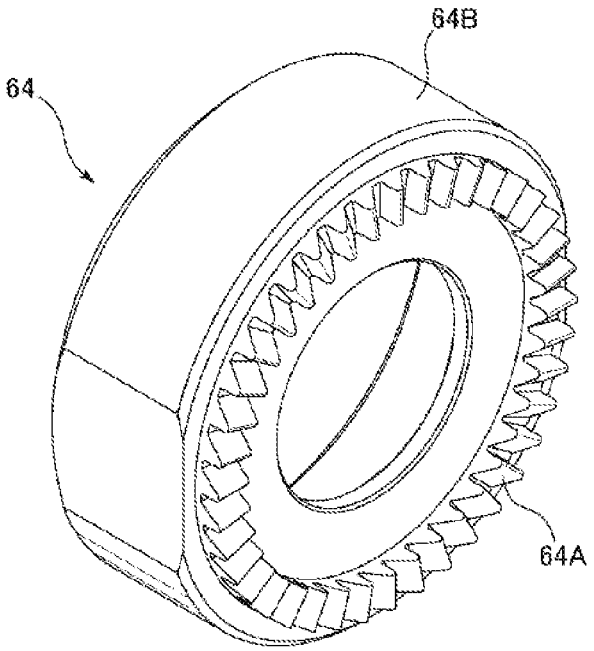
FIG. 10 is a perspective view of a nut clutch.

The structure of the third clutch can be explained from the spindle clutch 63 shown in FIG. 9 and the nut clutch 64 shown in FIG. 10.

Figure 11:
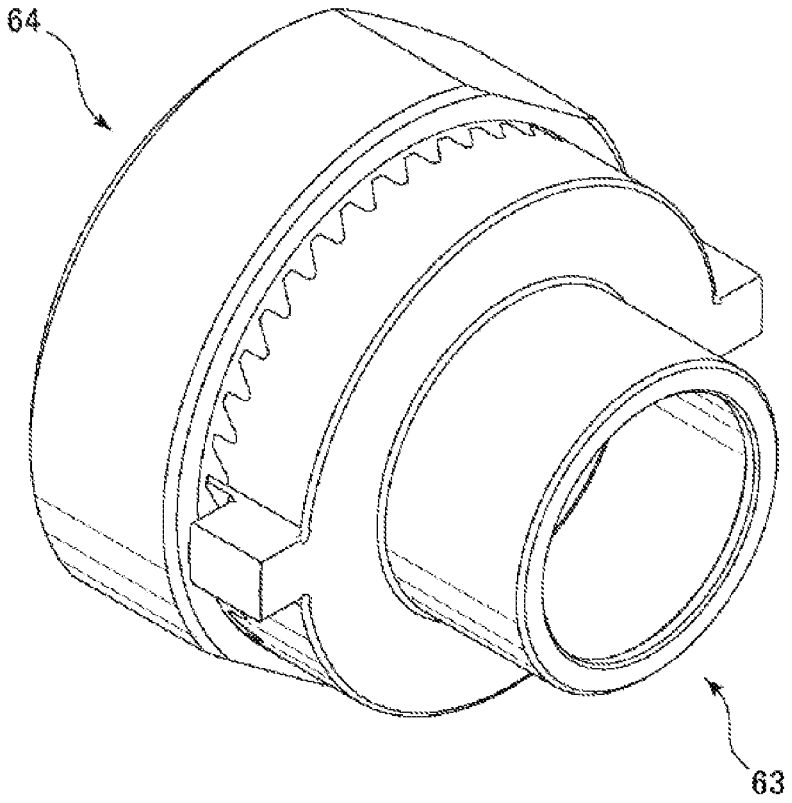
FIG. 11 is a diagram showing a connected state of a third clutch (a spindle clutch and a nut clutch).
Figure 12:
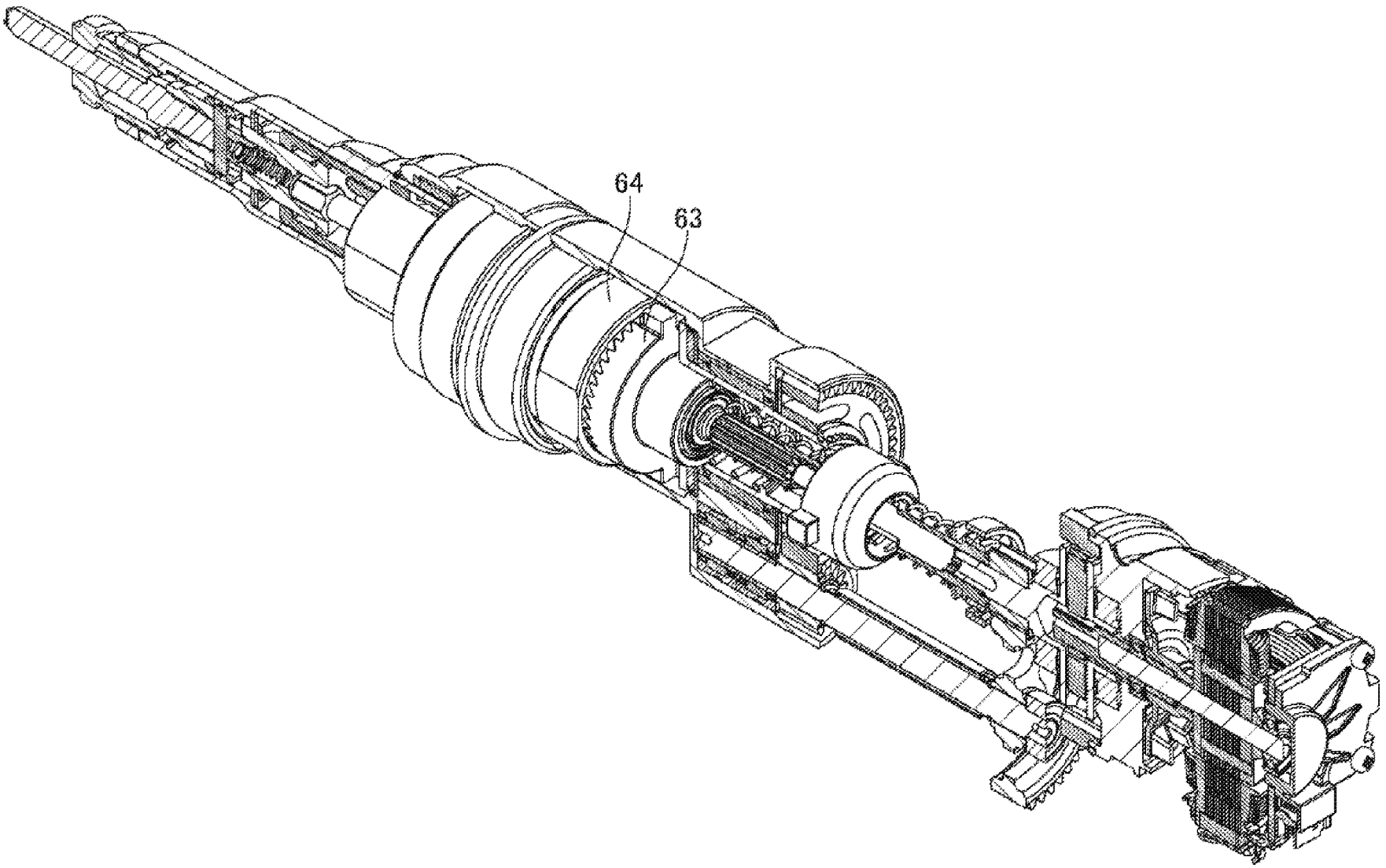
FIG. 12 is a perspective view showing a state in which the third clutch of FIGS. 9 and 10 is incorporated in the entire blind nut fastening apparatus.

FIG. 11 shows a state in which the spindle clutch 63 and the nut clutch 64 are connected. FIG. 12 is a perspective view showing a state in which the third clutch of FIGS. 9 and 10 is incorporated in the entire blind nut fastening apparatus.

The spindle clutch 63 has a cylindrical unit 63D connected to the spindle 14, and a flange unit 63C formed at a stage preceding the cylindrical unit 63D. The flange unit 63C has an engaging unit 63A for engaging with the nut clutch 64 of the preceding stage. A projection 63B protruding outward in the radial direction is formed on a part of the flange unit 63C. The protrusion 63B is engaged with an axially extending slot (not shown) formed in the spindle 14, and rotates the spindle clutch 63 as the spindle 14 rotates.

The nut clutch 64 is disposed in the preceding stage of the spindle clutch 63, and has a cylindrical unit 64B, and an engaging unit 64A for engaging the spindle clutch 63. The engaging unit 64A scrolls the ball screw shaft 36 in the axial direction by rotating the ball screw nut 44 at the preceding stage with the rotation of the engaging unit 63A of the spindle clutch 63. As will be described later, the third clutch strokes in the direction of pulling in the mandrel 75 at the time of engagement. In this case, if the stroke exceeds a predetermined distance, the nut clutch 64 disengages from the spindle clutch 63 and prevents overstroke.

The engaging unit 64A scrolls the ball screw shaft 36 in the axial direction by rotating the ball screw nut 44 at the preceding stage with the rotation of the engaging unit 63A of the spindle clutch 63. As will be described later, the third clutch strokes in a direction to pull in the mandrel 75 at the time of engagement; however, in this case, when the stroke exceeds a predetermined distance, the nut clutch 64 is disengaged from the spindle clutch 63, and an overstroke can be prevented.

The motor control circuit 8 operates the brushless motor 12 in response to inputs from the trigger 6, the mandrel pressing detection switch 10, and the FR lever switch 4. For example, when the screw of the blind nut 70 is deformed due to the excessive stroke of the mandrel, the forcible reverse rotation may be performed by turning on the FR lever switch 4. When the FR lever switch 4 rotates in the reverse direction, the first clutch and the second clutch do not disengage due to the above-described structure. The rotation torque can be reliably transmitted to the mandrel 75.

[Operation Flow]

The operation of each component corresponding to the processing from mounting of the blind nut 70 to the mandrel 75 to fastening to the member to be mounted 72 will be described with reference to FIGS. 14 through 19.

Figure 14:
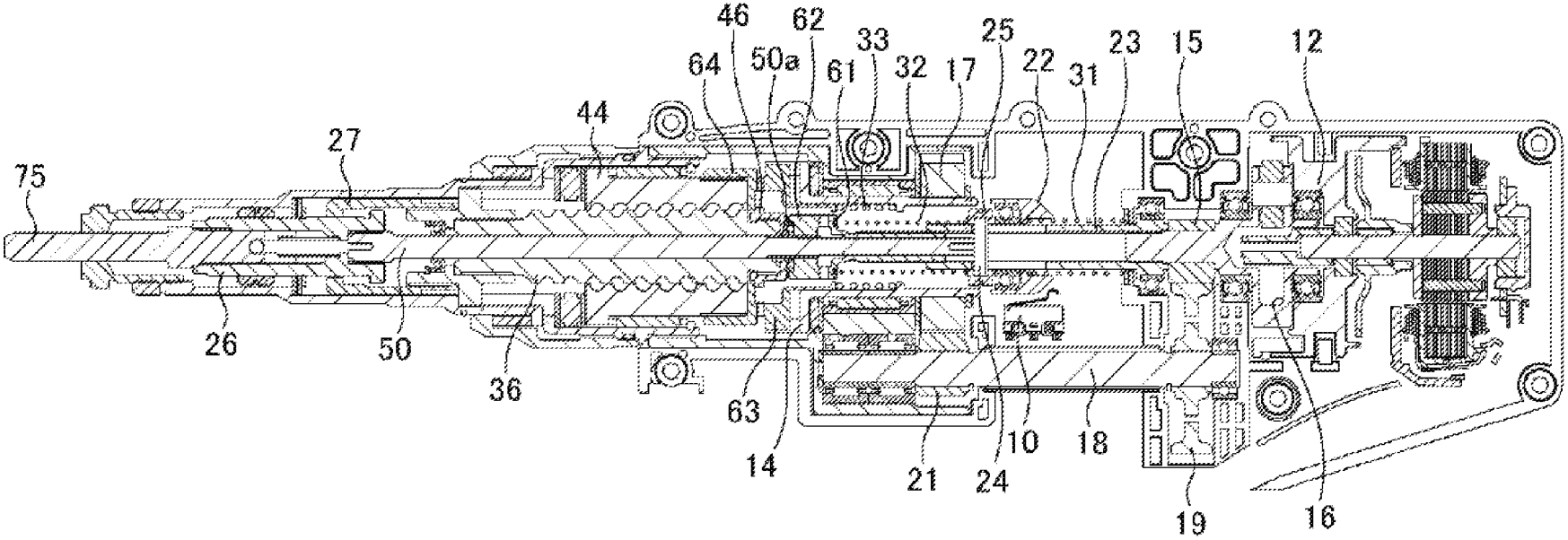
FIG. 14 is a cross-sectional view showing an initial state of the blind nut fastening apparatus.

FIG. 14 is a cross-sectional view showing an initial state of the blind nut fastening apparatus 1. The switch 10 is open.

Figure 15:
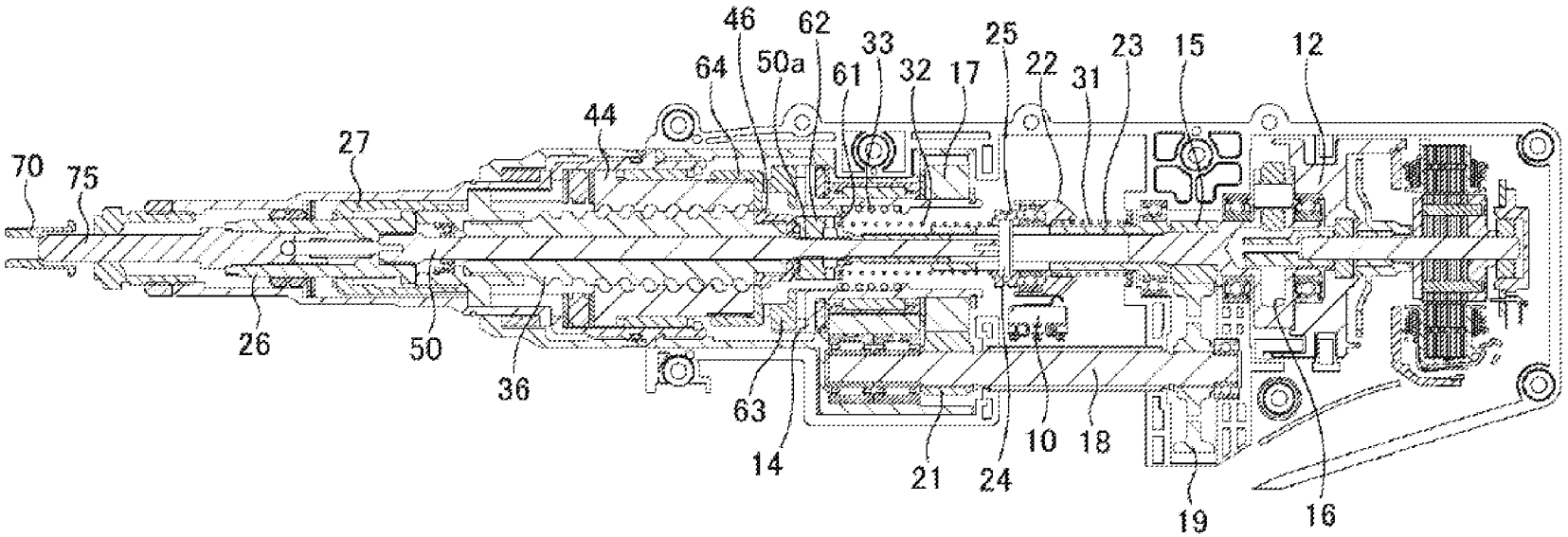
FIG. 15 is a cross-sectional view showing a state in which the blind nut is arranged at the tip of the mandrel and mounting is started.

FIG. 15 is a cross-sectional view showing a state in which the blind nut 70 is arranged at the tip of the mandrel 75 and mounting is started. When a worker (user) presses the blind nut 70 in the axial direction of the mandrel 75 in a state in which the blind nut 70 is disposed at the tip of the mandrel 75, the mandrel 75 strokes rightward in FIG. 15, and in conjunction therewith, the spin shaft 50 and the detection collar 22 also stroke rightward. When this happens, the spin shaft 50 becomes engaged with the inner shape of the front clutch nut 62 when the front clutch nut 62 is at the position of the engagement portion 50*a*, the switch 10 is connected to the detection collar 22 and is closed, and the brushless motor 12 operates. At this time, the rear clutch nut 61 and the front clutch nut 62 are also engaged with each other. Therefore, the rotational force from the joint shaft 23 is transmitted to the rear clutch nut 61, the front clutch nut 62, and the spin shaft 50 to rotate integrally, and the rotation of the mandrel 75 is started. The rear clutch nut 61 is supported by a spring 32 disposed in the interval with the pin holder 25 at the subsequent stage; at this time, the rear clutch nut 61 presses the front clutch nut 62 forward by the spring 32 to maintain the state of being engaged with the front clutch nut 62.

Figure 16:
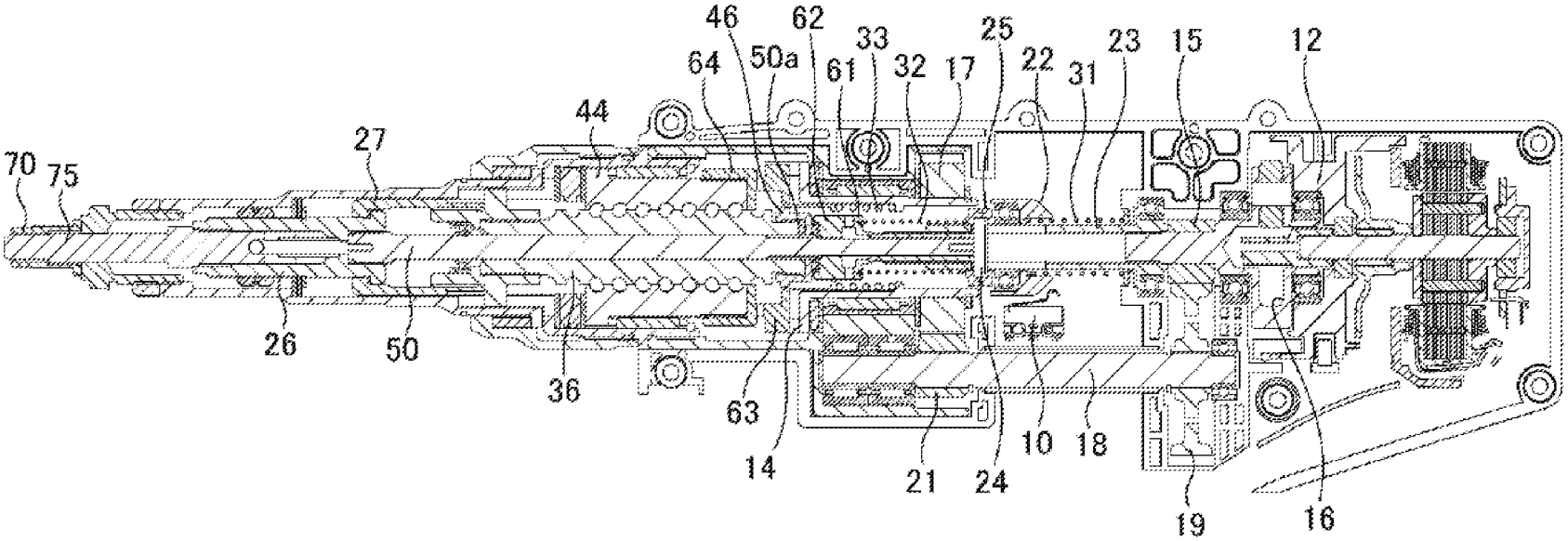
FIG. 16 is a cross-sectional view showing a state in which the mounting of the blind nut to the blind nut fastening apparatus is completed.

FIG. 16 is a cross-sectional view showing a state in which the mounting of the blind nut 70 to the mandrel 75 is completed. From the state of FIG. 15, as the mandrel 75 rotates, the blind nut 70 is gradually mounted on the mandrel 75, and the mandrel 75 gradually strokes toward the distal end. Then, when the mandrel 75 and the spin shaft 50 stroke in the distal direction to a position where the blind nut 70 is completely attached to the mandrel 75, the engaging unit 50*a* of the spin shaft 50 moves to a position displaced in the distal direction by the front clutch nut 62, and the engaging unit 50*a* of the spin shaft 50 does not engage with the inner shape (second clutch) of the front clutch nut 62. As a result, the rotational force is not transmitted to the mandrel 75 and the spin shaft 50, and the rotation of the mandrel 75 is also stopped. In addition, when the mounting of the nut is completed and the rotational load applied to the rear clutch nut 61 exceeds a certain value, due to the above-mentioned shape characteristics of the rear clutch nut 61 and the front clutch nut 62, their engagement is released, and the rotational force is not transmitted to the spin shaft 50. Also, at this timing, the spin shaft 50 and the detection collar 22 are also stroked to the left, the switch 10 does not come into contact with the detection collar 22, and the switch 10 is opened.

Figure 17:
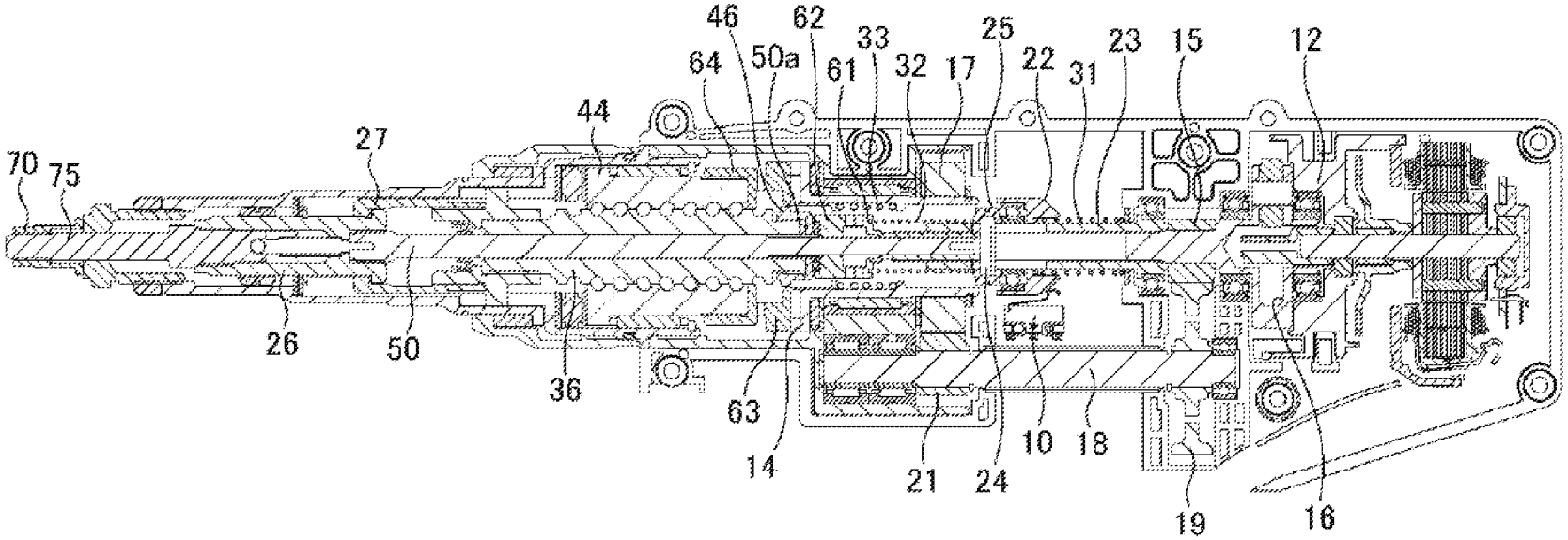
FIG. 17 is a cross-sectional view showing a state in which the engagement of the rear clutch nut and the front clutch nut (first clutch) is released when the installation of the blind nut is completed.

FIG. 17 is a cross-sectional view showing a state in which the engagement between the rear clutch nut 61 and the front clutch nut 62 (first clutch) is released after the mounting of the blind nut 70 is completed. When the mounting of the nut is completed, as described above, the rotational load applied to the rear clutch nut 61 exceeds a predetermined value. At this time, due to the above-mentioned shape characteristics of the rear clutch nut 61 and the front clutch nut 62, their engagement is released, and the rotational force to the spin shaft 50 is not transmitted. The rear clutch nut 61 may be configured to be held by the spring 32 that repeats expansion and contraction when the first clutch is disengaged.

In the state in which the installation of the blind nut 70 is completed, the ball screw shaft 36 is stroked backward by rotating the spindle 14 and the ball screw nut 44 a predetermined number of times, and as compared with the initial state of FIG. 14, a gap between the spin-pull head 26 and the spin-pull head case 27 is eliminated. This can be realized by setting the distance between the spin-pull head 26 and the spin-pull head case 27 in advance from the relationship between the brushless motor 12, the rotation speed, and the stroke distance.

Accordingly, when the trigger 6 is pulled in this state, the rotation of the brushless motor 12 is transmitted to the third clutch (the spindle clutch 63 and the nut clutch 64) via the spindle 14, the ball screw nut 44 is rotated by the rotational force from the third clutch, and the ball screw shaft 36 is moved in the direction of retraction. At this time, the spin-pull head case 27 linked to the ball screw shaft 36 is retracted without rotating the spin shaft 50 and the mandrel 75 via the spin-pull head 26, and the blind nut 70 is fastened to the member to be mounted.

Figure 18:
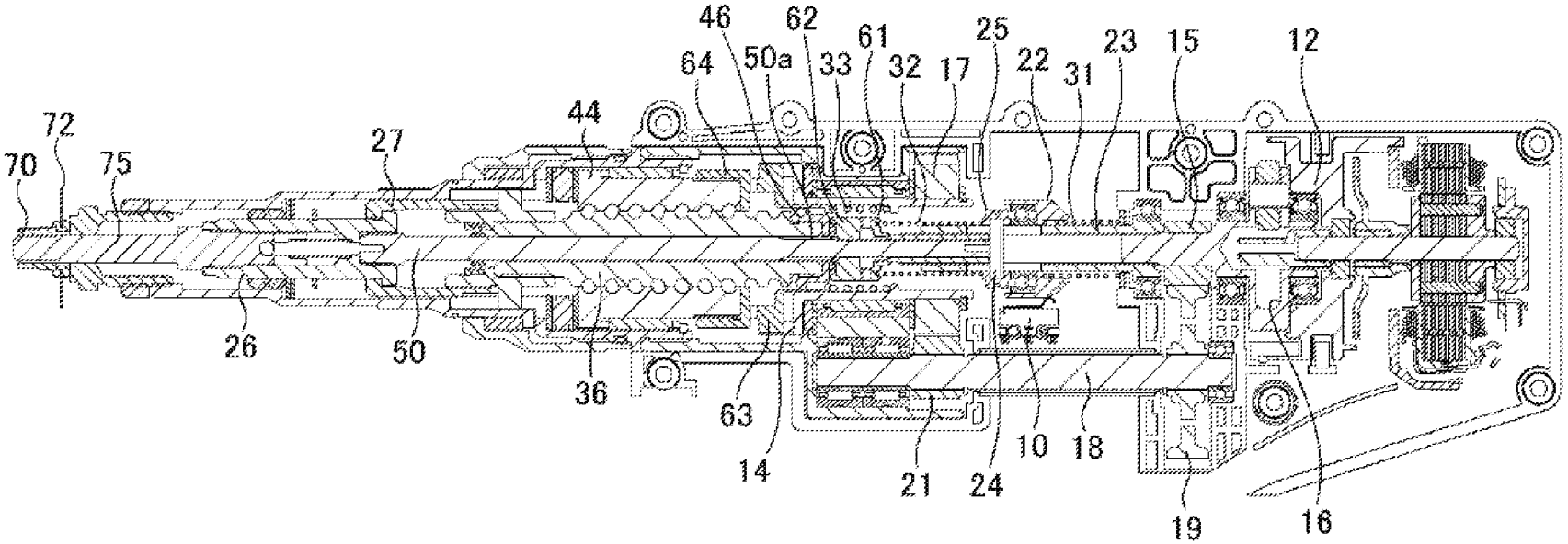
FIG. 18 is a cross-sectional view showing a state in which a blind nut is fastened to a member to be mounted.

FIG. 18 is a cross-sectional view showing a state in which the blind nut 70 is fastened to the member to be attached 72. As described above, in the state in which the blind nut 70 is mounted on the mandrel 75, the engagement of the first clutch and the second clutch (rotating clutch) is released, and the rotational force to the spin shaft 50 is not transmitted.

Here, the number of rotations of the brushless motor 12 corresponding to the amount of strokes from pulling the trigger 6 to completion of the engagement is set in advance by the control unit; in the fastening operation, the rotation direction of the brushless motor 12 may be automatically switched to the reverse rotation at the timing when the brushless motor 12 rotates by the set number of rotations (stroke management). Alternatively, setting may also be performed by calculating the fastening load from the load current flowing to the brushless motor at the time of fastening, and automatically switching the rotation direction of the brushless motor 12 to reverse rotation at the timing when the set fastening load is reached (management of fastening load).

After the blind nut 70 is fastened, the reverse rotation of the brushless motor 12 causes the second clutch to move toward the distal end relative to the spin shaft 50, and the second clutch is connected again. Then, the reverse rotation of the brushless motor 12 is transmitted to the mandrel 75, and the blind nut 70 can be removed from the mandrel. At this time, when the mandrel 75 is moved back to the original position so that the mandrel 75 does not overstroke in the forward direction, the third clutch is disengaged.

The spindle clutch 63 is supported by a spring 33 disposed between the spindle clutch 63 and the subsequent spindle 14; at this time, the spindle clutch 63 presses the nut clutch 64 forward by the spring 33 to maintain the state of engagement with the nut clutch 64.

Figure 19:
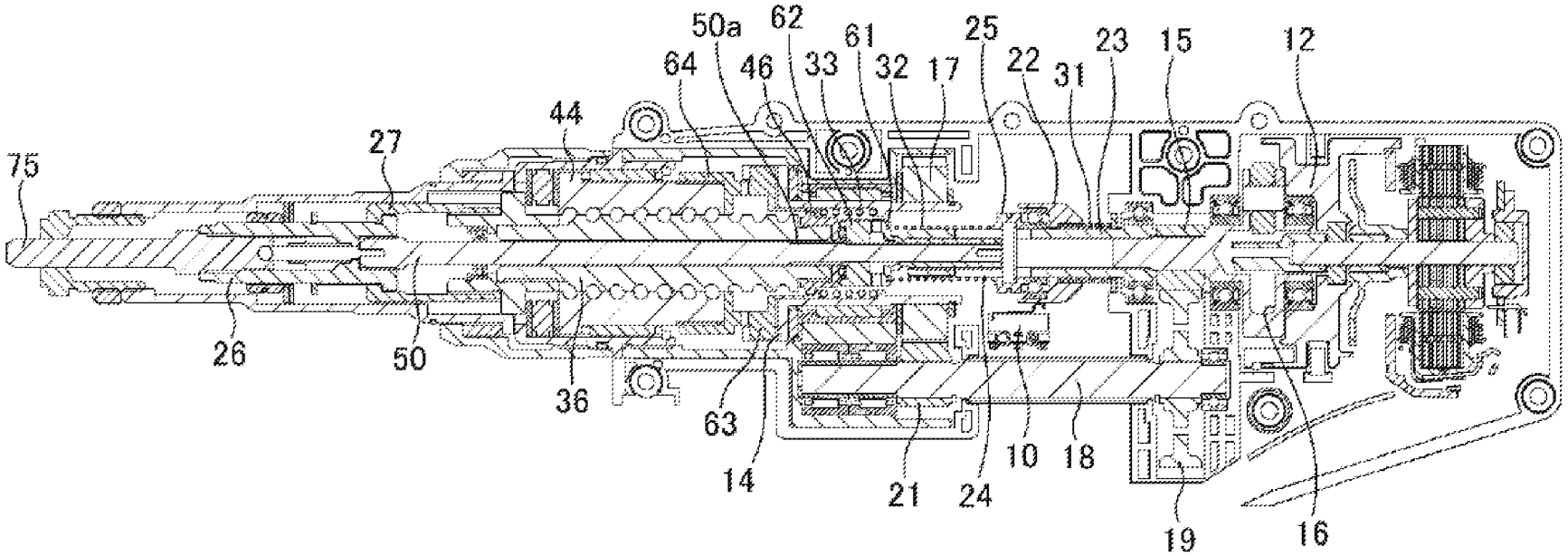
FIG. 19 is a cross-sectional view showing a state in which the third clutch is disengaged to prevent an overstroke of pulling of the spin shaft.

FIG. 19 is a cross-sectional view showing a state in which the third clutch is disengaged in order to prevent an overstroke of retraction of the spin shaft 50. When the retraction stroke of the spin shaft 50 reaches a predetermined distance, the tail cap 46 attached to the ball screw shaft 36 moves the spindle clutch 63 of the third clutch toward the rear end to disengage the third clutch. Thereby, the failure of the tool can be prevented without using a sensor.

According to the present disclosure, the mounting operation and the fastening operation can be individually performed, and the mounting operation is automatically processed, so that the mounting operation and the fastening operation can be performed by one trigger operation.

In this regard, by mounting the first and second clutches and the third clutch, the mounting operation and the fastening operation can be performed without a sensor for confirming the stroke position inside the tool. In addition, the rotation and the stroke of the mandrel can be controlled by controlling two power transmission systems with one motor.

As described above, the embodiments and working examples of the blind nut fastening apparatus according to the present disclosure have been described; however, it is easily understood that the present disclosure is not limited to the above-described working examples, and various changes can be made thereto. As long as they fall within the scope of matters described in each claim of the claims and matters equivalent thereto, they are naturally included in the technical scope of the present disclosure. In the above working examples, the engagement of the clutch was based on a predetermined shape, but this is merely an example, and the present disclosure is not limited to this specific example.

DESCRIPTION OF REFERENCE NUMERALS

1 Blind nut fastening apparatus
2 Display
3 Handle
4 FR lever switch
5 Battery
6 Trigger
7 Nose
8 Motor control circuit
9 Motor unit
10 Switch
11 Power transmission unit
12 Brushless motor
13 Electric motor
13A Hall element
14 Spindle
15 Motor gear
16 1st reduction unit
17 Spindle gear
18 Second shaft
19 Rear gear
21 Front gear
22 Detection color
23 Joint shaft
24 Pin
25 Pin holder
26 Spin pull head
27 Spin pull head case
31 Spring
32 Spring
33 Spring
36 Ball screw shaft
44 Ball screw nut
46 Tail cap
50 Spin shaft
50*a* Engagement unit
61 Rear clutch nut
61A 1st fan-shaped portion
61B 1st vertical plane
61C 1st slope
61D Rear end portion
62 Front clutch nut
62A Cylindrical unit
62B Second fan-shaped portion
62C Second vertical surface
62D Second inclined surface
63 Spindle clutch
63A Engaging unit
63B Projection
63C Flange unit
63D Cylindrical unit
64 Nut clutch
64A Engaging unit

64B Cylindrical unit
70 Blind nut
72 Member to be attached
75 Mandrel

What is claimed is:

1. A fastening apparatus for fastening a blind nut to a member to be mounted, the fastening apparatus provided with a power transmission unit configured to transmit the rotation of an electric motor, the power transmission unit having a first transmission system and a second transmission system, the fastening apparatus comprising:

a joint shaft that is arranged in front of the electric motor and is rotated by power transmitted by the first transmission system of the power transmission unit;

a spindle that is arranged in front of the electric motor and that is rotated by power transmitted by the second transmission system of the power transmission unit;

a spin shaft that grips a shaft unit of a mandrel and rotates the mandrel with rotation of the joint shaft;

a rotating clutch for transmitting the rotational force of the joint shaft to the spin shaft; and a stroke clutch that is disposed between a stroke mechanism and the spindle, and that transmits the rotation of the spindle to the stroke mechanism, the stroke mechanism translating the mandrel with rotation of the spindle, wherein:

the rotating clutch is provided with a rear clutch nut and a front clutch nut arranged in front of the rear clutch nut;

the rear clutch nut transmits the rotational force of the joint shaft to the front clutch nut when engaged with the front clutch nut, but is disengaged from the front clutch nut by a predetermined rotational load;

the front clutch nut has a cylindrical shape so that the spin shaft can be arranged at an axial center portion of the front clutch nut, and the front clutch nut is configured so that when it is engaged with an engagement unit of the spin shaft, a rotational force is transmitted to the spin shaft, but the front clutch nut is disengaged from the spin shaft by a predetermined stroke shaft an axial direction;

the stroke clutch is provided with a spindle clutch and a nut clutch arranged in front of the spindle clutch; and the spindle clutch transmits the rotational force of the spindle to the stroke mechanism when engaged with the nut clutch, but is disengaged from the nut clutch by a predetermined stroke rearward.

2. The fastening apparatus according to claim 1, wherein the stroke mechanism that translates the mandrel is provided with a cylindrical ball screw nut that rotates with the rotation of the spindle clutch and the nut clutch, and a ball screw shaft that is established at the center of the ball screw nut and moves in the axial direction with the rotation of the ball screw nut to translate the mandrel.

3. The fastening apparatus according to claim 2, further comprising a spin-pull head case that is arranged on the tip side of the ball screw shaft and moves in the same direction as the ball screw shaft with the stroke of the ball screw shaft, wherein when the spin-pull head case moves a predetermined distance in a rearward direction, it is fitted with a spin-pull head disposed on the front end side of the spin shaft, and moves so as to retract the mandrel together with the spin-pull head.

4. The fastening apparatus according to claim 1, further comprising a switch for starting the electric motor by pressing the mandrel in the axial direction, wherein when the tip of the mandrel is pressed rearward in a state in which the blind nut is disposed at the tip of the mandrel, the switch of the electric motor is closed by the rotational force from the electric motor, and the mandrel is rotated via the spin shaft engaged with the rotating clutch, and when the blind nut is mounted on the mandrel, the mandrel and the spin shaft are translated in a distal direction so that the spin shaft is disengaged from the rotation rotating clutch and the switch is opened, and in a state in which the spin shaft is disengaged from the rotating clutch, when the electric motor is started via a trigger by a user's operation, the spindle is rotated and the mandrel is translated in a rearward direction via the stroke mechanism so that the blind nut is fastened to the member to be mounted.

5. The fastening apparatus according to claim 1, wherein the rear clutch nut has a cylindrical unit, a flange unit at one end of the cylindrical unit, and a plurality of first fan-shaped portions formed on a front surface of the flange unit, the first fan-shaped portions having one end in a circumferential direction with a first vertical surface perpendicular to an end surface of the flange unit, the first fan-shaped portions having another end with a first inclined surface inclined with respect to the end surface of the flange unit, the first fan-shaped portions being configured to rotate integrally with the joint shaft, the front clutch nut having a plurality of second fan-shaped portions with a shape complementary to the first fan-shaped portions, the second fan-shaped portions having one end in the circumferential direction with a second vertical surface perpendicular to an end surface of the front clutch nut, the front clutch nut having another end with a second inclined surface inclined with respect to the end surface of the front clutch nut, the second vertical surface of the second fan-shaped portions of the front clutch nut being engageable with the first vertical surface of the first fan-shaped portions of the rear clutch nut the second inclined surface of the second fan-shaped portions of the front clutch nut being engageable with the first inclined surface of the first fan-shaped portions of the rear clutch nut the front clutch nut being configured to rotate integrally with the rear clutch nut.

6. The fastening apparatus according to claim 5, wherein when the blind nut is mounted on the mandrel and the spin shaft cannot rotate, the first inclined surface of the first fan-shaped portions of the rear clutch nut slips with the second inclined surface of the second fan-shaped portions of the front clutch nut so that the rear clutch nut moves rearward.

7. The fastening apparatus according to claim 1, wherein the engagement unit of the spin shaft has a plurality of small-diameter portions having a diameter smaller than a diameter of a columnar shape on a distal end side of the engagement unit, a rear end side of the engagement unit of the spin shaft has a diameter smaller than the diameter of the small-diameter portions of the engagement unit, and a cylindrical inner portion of the front clutch nut has a shape complementary to the engagement unit.

* * * * *